US007052357B2

(12) United States Patent
Silverglate

(10) Patent No.: US 7,052,357 B2
(45) Date of Patent: May 30, 2006

(54) TOY SUBMERSIBLE PROJECTILE

(75) Inventor: David Silverglate, Santa Cruz, CA (US)

(73) Assignee: Big Time Toys, LLC, Brentwood, TN (US)

( * ) Notice: Subject to any disclaimer, the term of this patent is extended or adjusted under 35 U.S.C. 154(b) by 0 days.

(21) Appl. No.: 10/838,604

(22) Filed: May 4, 2004

(65) Prior Publication Data

US 2005/0250409 A1 Nov. 10, 2005

(51) Int. Cl.
*A63H 23/00* (2006.01)

(52) U.S. Cl. ..... 446/153; 446/64

(58) Field of Classification Search ..... 446/153, 446/154, 161, 163, 63, 64; 114/20.1
See application file for complete search history.

(56) References Cited

U.S. PATENT DOCUMENTS

| | | | | |
|---|---|---|---|---|
| 344,718 | A | 6/1886 | Campbell et al. | |
| 1,324,961 | A | 12/1919 | Grantham | |
| 1,612,794 | A * | 1/1927 | Bender | 446/161 |
| 1,994,490 | A | 3/1935 | Skinner | |
| 2,480,927 | A | 9/1949 | Hopkins | |
| 2,925,276 | A | 2/1960 | Leclerc | |
| 3,141,434 | A | 7/1964 | Billiard | |
| 3,216,727 | A | 11/1965 | Hunter | |
| 3,225,488 | A | 12/1965 | Goldfarb | |
| 3,434,425 | A | 3/1969 | Critcher | |
| 3,516,358 | A | 6/1970 | Manninen et al. | |
| 3,544,113 | A | 12/1970 | Hand | |
| 3,575,123 | A | 4/1971 | Hopewell et al. | |
| 3,727,570 | A | 4/1973 | Molinski | |
| 3,754,349 | A | 8/1973 | Wallace | |
| 3,898,765 | A * | 8/1975 | Lee | 446/63 |
| 3,915,092 | A | 10/1975 | Monson et al. | |
| 4,109,579 | A | 8/1978 | Carter | |
| 4,240,396 | A | 12/1980 | Randoll | |
| 4,395,965 | A | 8/1983 | Lang | |
| 4,448,106 | A | 5/1984 | Knapp | |
| 4,569,300 | A | 2/1986 | Ferris et al. | |
| 4,748,912 | A | 6/1988 | Garcia | |
| 4,913,675 | A * | 4/1990 | Wilcox | 446/36 |
| 4,922,884 | A | 5/1990 | Ford | |
| 4,979,922 | A | 12/1990 | Clark | |
| 5,080,017 | A | 1/1992 | Asikainen | |
| 5,129,325 | A | 7/1992 | Matzagg | |
| 5,306,191 | A | 4/1994 | Phillips et al. | |
| 5,499,822 | A | 3/1996 | Sabourin | |
| 5,514,023 | A | 5/1996 | Warner | |
| 5,579,749 | A | 12/1996 | Wilkinson | |
| 5,807,198 | A | 9/1998 | Grimm | |
| 5,865,662 | A | 2/1999 | Dammann | |
| 5,886,839 | A | 3/1999 | Arnone et al. | |

(Continued)

OTHER PUBLICATIONS

Internet Advertisement, Swim Ways TOYPEDO (1 pg.).

(Continued)

*Primary Examiner*—Kien Nguyen
(74) *Attorney, Agent, or Firm*—Stephen T. Belsheim

(57) ABSTRACT

A submersible projectile includes an elongate body. The elongate body has an axial forward end and an axial rearward end and a peripheral surface. The elongate body has a generally elliptical cross-section along substantially all of the axial length of the elongate body. A plurality of fins project from the elongate body near the axial rearward end of the body wherein the fins are spaced about the peripheral surface.

13 Claims, 3 Drawing Sheets

U.S. PATENT DOCUMENTS

| | | | | |
|---|---|---|---|---|
| 6,093,076 | A * | 7/2000 | Street | 446/156 |
| 6,146,292 | A | 11/2000 | Yamanaka | |
| 6,328,622 | B1 | 12/2001 | Geery | |
| 6,500,042 | B1 | 12/2002 | LaPointe | |
| 6,511,074 | B1 | 1/2003 | Fireman | |
| 6,699,091 | B1 * | 3/2004 | Warner | 446/153 |

OTHER PUBLICATIONS

Internet Advertisement, Backyard Toys, "The Original Toypedo" (1 pg.).

Declaration of Joseph Pokowitz and attachments (5 pages).

* cited by examiner

TOY SUBMERSIBLE PROJECTILE

BACKGROUND OF THE INVENTION

The present invention relates to a toy submersible projectile for recreational use. More specifically, the invention pertains to an improved toy submersible projectile wherein such projectile exhibits hydrodynamic properties such that it travels in water along a gradually descending substantially straight line path without experiencing any sudden diving or stalling, especially when being launched under the influence of a propulsion member.

Over the years, both children and adults alike have engaged in playing with a variety of hand-launched submersible objects that travel underwater. While there a number of environments in which persons play with submersible objects, one such environment is a swimming pool. In the underwater environment of a swimming pool, for example, the user derives great benefit and enjoyment from playing with the submersible object (e.g., a submersible projectile) when the submersible projectile travels in a stable fashion along a gradually descending straight line path. This is in contrast to a submersible projectile which exhibits sudden dines or climbs and stalls upon launch. Such unpredictable travel is unacceptable and can result in frustration, as well as a decrease in enjoyment for the user.

There are many factors that go into the design of a submersible projectile. In this regard, a design of a submersible projectile can experience difficulty in balancing the amount of hydrodynamic lift provided by the design and shape of the body of the projectile against the degree of stabilization provided by the fins that typically project from the rearward portion of the projectile. If these factors are not properly balanced, then the projectile may encounter difficulty in traveling in water at both high speeds and at low speeds in a satisfactory manner. Thus, it would be highly desirable to provide an improved submersible projectile that balances the amount of hydrodynamic lift provided by the body of the projectile against the degree of stabilization provided by the fins whereby upon being launched (or catapulted), the submersible projectile travels in water at both high speeds and at low speeds in a satisfactory fashion (e.g., a gradually descending substantially straight line path).

The user also experiences great enjoyment when the submersible projectile travels a gradually descending straight line path over a relatively great distance. In view of the nature of being underwater and the inherent resistance of the water, it is difficult for the user themselves to generate sufficient initial velocity and acceleration so as to achieve a relatively long travel distance. In the absence of a launch member that produces the necessary acceleration to achieve the greater travel distances, the user who wants to achieve a longer travel distance can experience frustration and a decrease in the enjoyment of the projectile. Thus, it would be highly desirable to provide an improved submersible projectile that includes a propulsion (or catapult) member whereby the user can launch the submersible projectile at a greater speed than can be done through hand launching, and as a result, achieve a longer travel path.

As found in toy gliders, a propulsion member, such a separate catapult launcher, can typically allow the user to launch the projectile at a higher velocity or quicker acceleration than by hand launching the projectile. However, when the propulsion member is a separate member, there are certain disadvantages associated therewith. For example, the separate launcher can be lost so that the enjoyment of the toy is significantly diminished. Thus, it would be highly desirable to provide an improved submersible projectile that includes a propulsion member that is a self-contained part of the submersible projectile so that the submersible projectile is a self-contained structure that can be launched other than by hand and at higher speeds than can be achieved with a hand launch.

When the propulsion member is a separate member from the submersible projectile, it is sometimes difficult for the user to align the propulsion member along the launch direction. It would also be highly desirable to provide an improved submersible projectile that contains a propulsion member that can be aligned in a generally parallel direction to the launch direction so that the submersible projectile is a self-contained structure that can be accurately launched along a selected launch direction other than by hand. Because it sometimes difficult for the user when underwater to accurately sight, as well as, determine a proper launch vector for a submersible projectile, it would be highly desirable to provide a submersible projectile that assists the user in sighting and aligning the submersible projectile and in determining an appropriate launch vector for the submersible projectile.

Sometimes the user can interfere with the unobstructed launch of the submersible projectile wherein this can be especially true for a projectile that uses a separate propulsion member such as, for example, a rubber band attached to a stick. In the case of a toy glider, the user temporarily attaches a free end of the elastic band to a single attachment point on the glider, holds the stick in one hand via an outstretched arm, and pulls the glider back with the other hand until the elastic band is taut. The user next releases the glider, sending it catapulting toward the stick. With luck, the glider will miss the stick and be successfully launched. Unfortunately, luck does not always prevail, and the glider often crashes into the stick or hand of the user. This experience can be frustrating, and tends to decrease the enjoyment of these devices by users. Thus, it would be highly desirable to provide an improved submersible projectile wherein the user is able to grasp the projectile in such a fashion that the user does not interfere with an unobstructed launch of the projectile in a fashion other than by hand.

SUMMARY OF THE INVENTION

In one form thereof, the invention is a submersible projectile that comprises an elongate body that has an axial forward end and an axial rearward end and a peripheral surface. The elongate body has a generally elliptical cross-section along substantially all of the axial length of the elongate body. A plurality of fins project from the elongate body near the axial rearward end of the body wherein the fins are spaced about the peripheral surface.

In another form thereof, the invention is a submersible projectile that comprises an elongate body that has an axial forward end and an axial rearward end and a peripheral surface. The elongate body has a specific gravity equal to between about 1.15 and about 1.20. The elongate body has a generally elliptical cross-section along substantially all of the axial length of the elongate body. The ellipse defined by the elongate body in cross-section has an eccentricity equal to between about 0.75 and 0.85. A trio of fins project from the elongate body near the axial rearward end of the body. The fins are spaced about the peripheral surface. One of the fins projects in a radial fashion away from the elongate body and the other two of the fins project in a non-radial fashion away from the elongate body.

In still another form thereof, the invention is a submersible projectile that comprises an elongate body that has an axial forward end and an axial rearward end and a peripheral surface. The elongate body has a generally elliptical cross-section along substantially all of the axial length of the elongate body. The elongate body contains a propulsion member. A plurality of fins project from the elongate body near the axial rearward end of the body. The fins are spaced about the peripheral surface. One of the fins projects in a radial fashion away from the elongate body and at least two of the fins project in a non-radial fashion away from the elongate body.

In another form thereof, the invention is a submersible projectile that comprises an elongate body that has an axial forward end and an axial rearward end and a peripheral surface. The elongate body has a generally elliptical cross-section along substantially all of the axial length of the elongate body. A trio of substantially identical fins project from the elongate body near the axial rearward end of the body wherein the fins are spaced about the peripheral surface. One of the fins projects in a radial fashion away from the elongate body. The other two of the fins project in a non-radial fashion away from the elongate body. Each one of the non-radial fins is spaced apart from the radial fin between about 130 degrees and about 135 degrees.

BRIEF DESCRIPTION OF THE DRAWINGS

Set forth below is a brief description of the drawing figures which form a part of this patent application.

DETAILED DESCRIPTION OF AN EMBODIMENT

Figure 1:
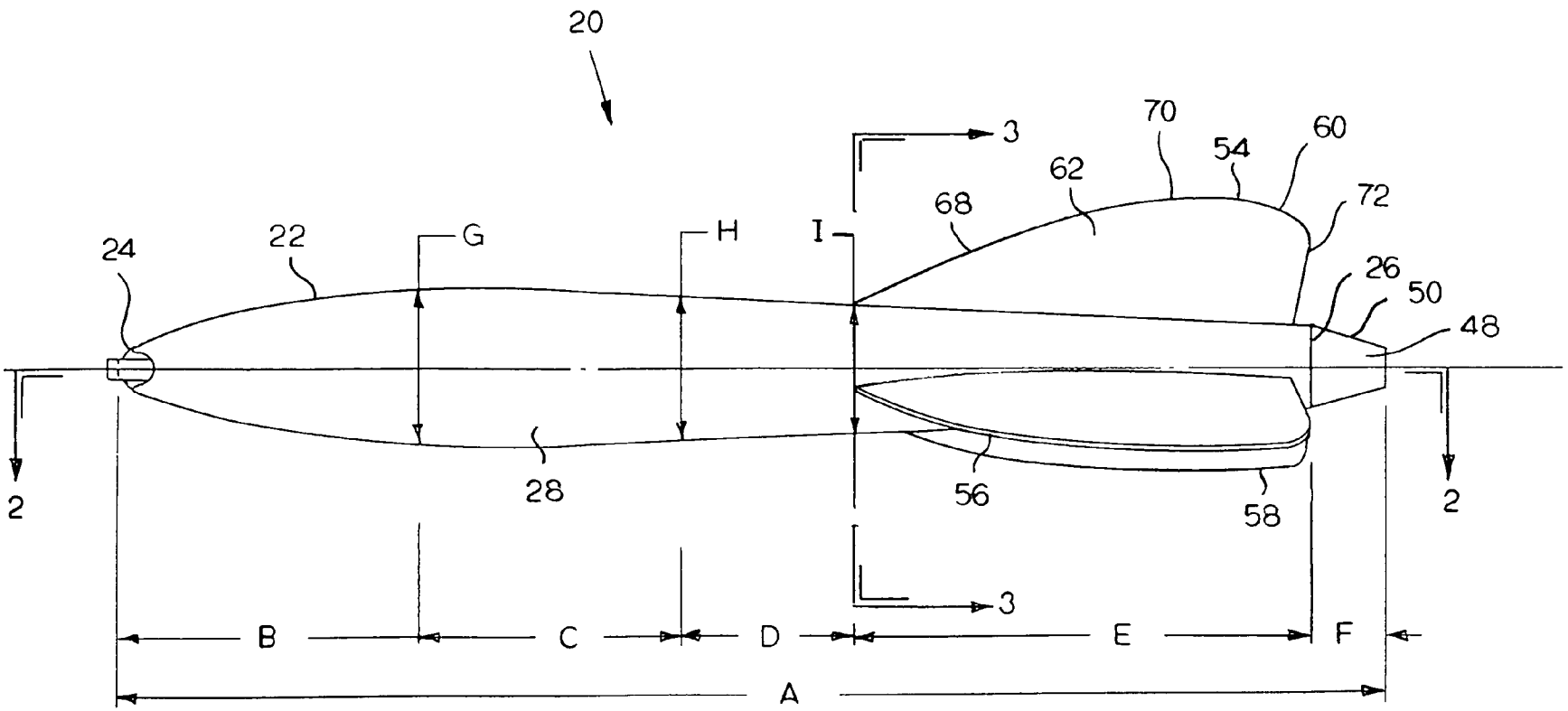
FIG. 1 is a side view of a specific embodiment of the submersible projectile.

Referring to the drawings, there is illustrated a specific embodiment of the submersible projectile generally designated as 20. The submersible projectile 20 is typically used as a toy submersible projectile for use in a body of water such as, for example, a swimming pool. As will become apparent, the submersible projectile 20 contains a propulsion (or launch) feature so that it is a self-contained launch vehicle that has been optimized for best flights by providing an attached elastic launcher aligned with and parallel to the launch direction, a body shaped for best high and low speed flights (an elongated elliptical body with rear gripping surface), and fins placed to allow for stable flight (center-of-effort vs. center-of-pressure for top and side forces) while keeping them out of the way of the user's fingers/hands (i.e. lower fins not aligned to center axis).

Submersible projectile 20 includes an elongate projectile body 22 wherein such projectile body 22 has an axial forward end (or leading end) 24 and an axial rearward end (or trailing end) 26. Although the materials may vary, one preferred material for the elongate projectile body 22 is a urethane that has a specific gravity equal to between about 1.15 and about 1.20.

Projectile body 22 further includes an exterior surface 28. The elongate projectile body 22 contains an axial forward opening 30 (see FIG. 2) at the axial forward end 24 thereof, as well as an axial rearward cavity 32 (see FIG. 2) adjacent the axial rearward end 26 thereof. Projectile body 22 further contains a pair of generally parallel spaced apart axial channels (or passages) 34 and 36 that extend the entire axial length of the projectile body 22. Channels 34 and 36 are generally cylindrical in shape. These channels 34 and 36 are generally parallel to the longitudinal axis of the projectile body 22. As will become apparent hereinafter, these channels 34 and 36 are also in general alignment with the direction of launch of the projectile 20.

The submersible projectile 20 further includes a rearward plug 42 (see FIG. 2) that presents an axial forward reduced diameter portion 44 that contains a volume 46. Rearward plug 42 further includes an enlarged diameter portion 48 that presents a roughened surface that provides a thumb grasp 50 area. The thumb grasp area 50 allows the user to securely grip and pull the projectile 20 to effect the launch of the projectile 20 as will be described hereinafter. The reduced diameter portion 44 of rearward plug 42 is secured (i.e. affixed) within the axial rearward cavity 32 of the projectile body so as to be essentially permanently affixed to the projectile body 22.

Submersible projectile 20 further includes a trio of generally planar integral fins 54, 56 and 58. The fins (54, 56, 58) are made out of the same material as the projectile body 22. The following description of fin 54 will suffice for the description of the other fins 56 and 58 since all three fins are substantially identical to one another.

Fin 54 has a peripheral edge 60 that extends along the entire periphery thereof. Fin 54 further includes one generally planar side 62 and an opposite other generally planar side 64. Sides 62 and 64 define an area that provides for the stabilization of the submersible projectile 20 during its travel under water.

Although the surface area presented by fin 54 will be discussed in more detail hereinafter, the amount of surface area of fin 54 relative to the cross-sectional area of the projectile body 22 influences the stability of the projectile 20 during travel. Very briefly, the area of the fins provides directional stabilization and the elliptical cross-section of the projectile body 22 provides the hydrodynamic lift. If the area of the fins is too great relative to the cross-section of the projectile body 22, then the projectile 20 will sharply dive upon being launched. If the area of the fins is too small, the projectile will travel upwardly and stall.

The edge 60 of fin 54 includes an axial forward edge portion 68 that is slightly arcuate. The edge 60 of fin 54 also has a mediate edge portion 70 which is axially rearward of forward edge portion 68 and is also slightly arcuate. The edge 60 of fin 54 also has a trailing edge portion 72 which is axially rearward of the mediate edge portion 70 and is generally straight and vertically disposed as shown in FIG. 1.

Figure 3:
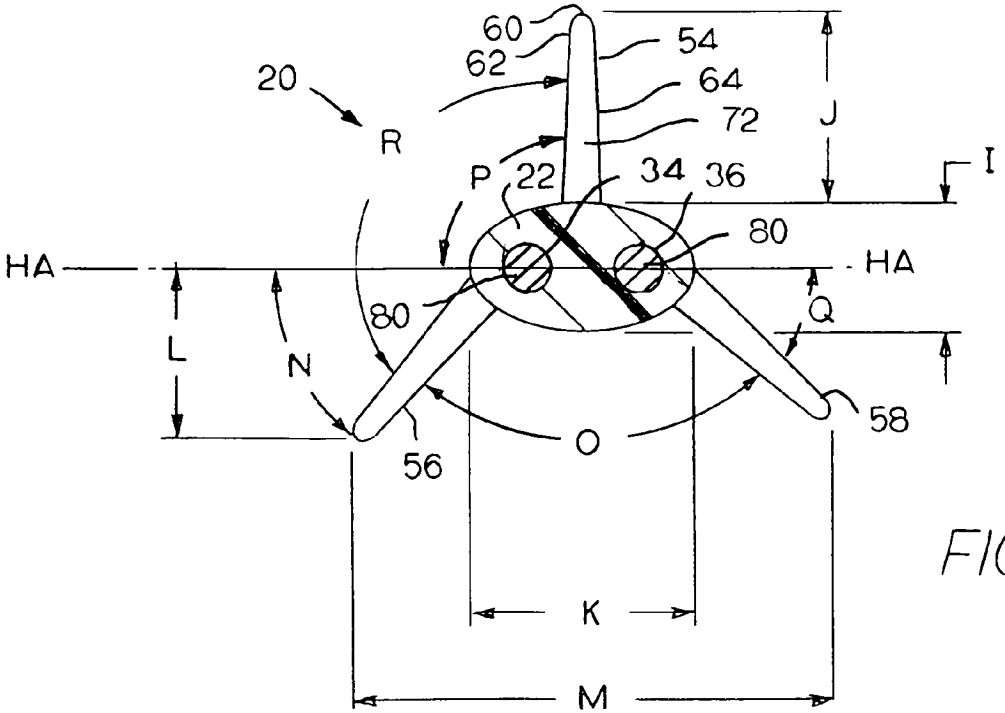
FIG. 3 is a rear view in cross-sectional of the specific submersible projectile of FIG. 1 taken along section line 3—3 of FIG. 1.

It should be appreciated that the fins 54, 56 and 58 do not have the same orientation with respect to the elongate body 22 of the submersible projectile 20. Fin 54 is radially-oriented with respect to the elongate body 22 as is shown by FIG. 3. Fins 56 and 58 are not radially-oriented, but are disposed so as to be not aligned with the central longitudinal axis of the projectile 20. In this regard, non-radial fins 56 and 58 are disposed at an angle "O" apart from each other. Each one of non-radial fins 56 and 58 is disposed at angle "N" and angle "Q", respectfully from the horizontal axis (HA) as shown in FIG. 3. Each one of non-radial fins 56 and 58 is disposed at an angle "R" from the radial fin 54. The magnitudes of these angles are set out in Table 1 hereinafter.

As illustrated in FIG. 3, the elongate projectile body 22 has a generally elliptical cross-section. In this specific embodiment, this elliptical geometry extends along the entire length of the projectile body 22. However, it should be appreciated that the entire projectile body 22 may not necessarily have an elliptical cross-section. The eccentricity of the elliptical cross-section is about 0.78 and ranges between about 0.75 and about 0.85.

Figure 2:
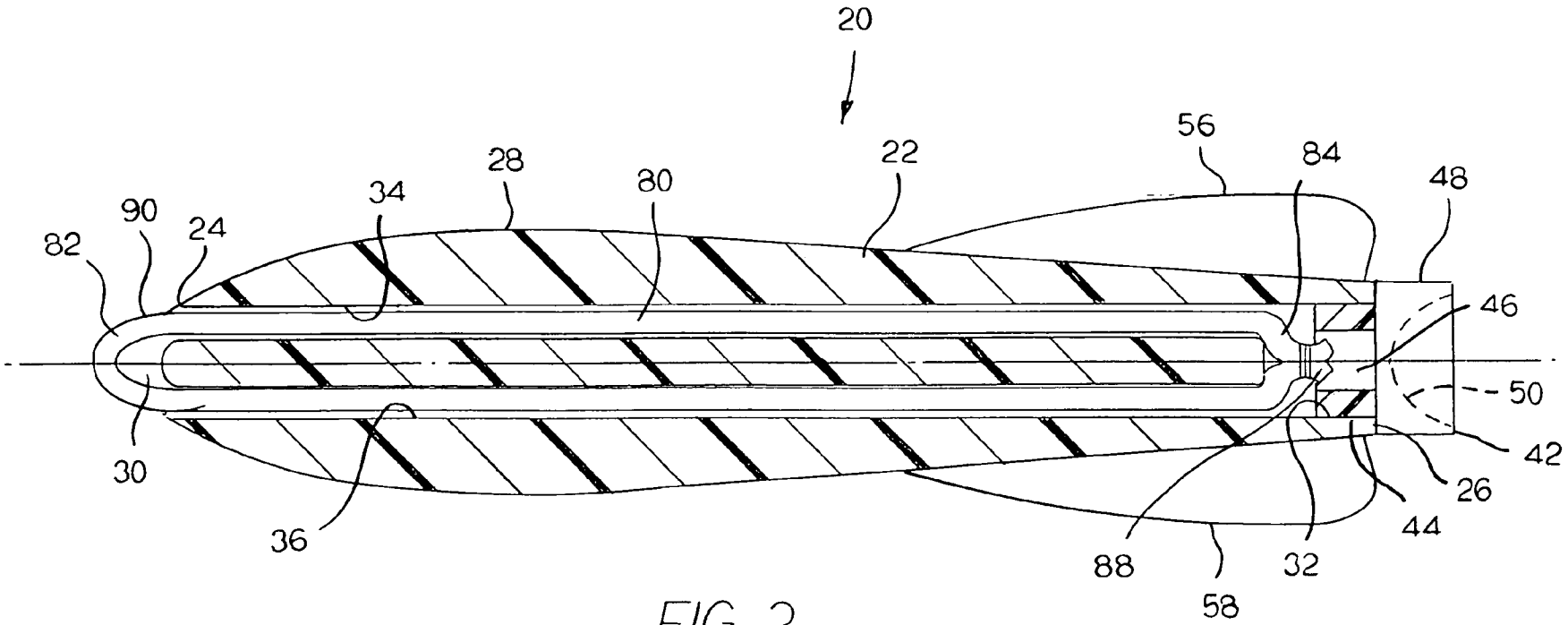
FIG. 2 is a top view in cross-section of the submersible projectile of FIG. 1 taken along section line 2—2 of FIG. 1.

The submersible projectile 20 further includes a propulsion member in the form of an elongate elastic launch member 80. Elastic launch member 80 has an axial forward end 82 and an axial rearward end 84. As can be seen especially in FIG. 2, the elastic launch member is 80 contained within the pair of generally parallel spaced-apart channels 34 and 36. The elastic launch member 80 is fixed at its axial rearward end (point 88 in FIG. 2). As shown in FIG. 2, an axial forward portion 90 of elastic launch member 80 is exposed so that a user can grasp the axial forward portion 90 of the elastic launch member 80 at the axial forward opening 30 of the projectile body 22.

Figure 4:
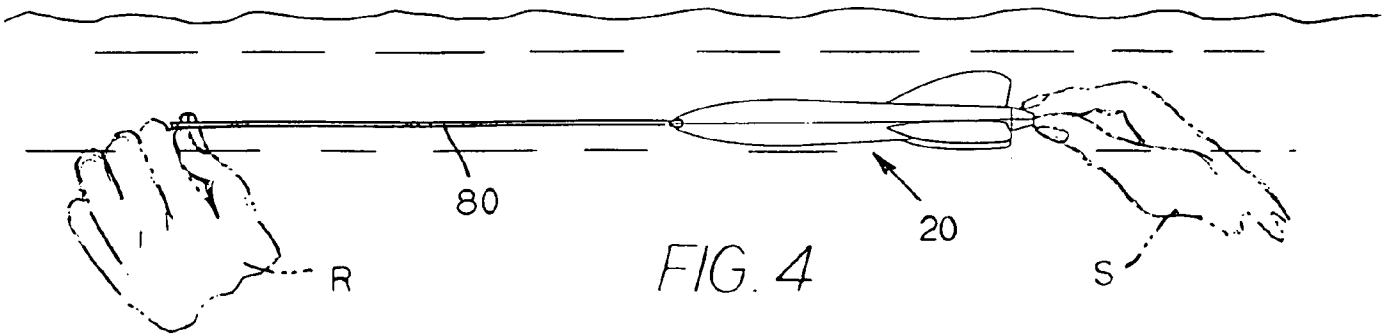
FIG. 4 is an isometric view of the submersible projectile being held by a user whereby the propulsion member in the form of an elastic launch member is stretched (or extended) so as to make the submersible projectile ready for propulsion-assisted launching.

As shown in FIG. 4, in order to launch the submersible projectile 20 under the influence of the elastic launch member 80, the user grasps the axial forward portion 90 of the elastic launch member 80. The user also grasps the thumb grasp area 50 of the rearward plug 42. The user then pulls the submersible projectile 20 back so as to stretch the elastic launch member 80. The elastic launch member 80 has an axial length that is slightly less than the overall length of the submersible projectile 20. In a projectile such as this that includes a self-contained propulsion member, the axial length of the elastic launch member 80 enhances the ability to store energy for launch. This is the case because the longer the elastic launch member 80, the greater its ability to store energy for launch.

Once the user has stretched the elastic band 80 to the desired force, and has aimed the projectile, as well as determined the launch vector, the user then lets go of the thumb grasp 50 and the submersible projectile 20 travels through the water in a stable gradually descending straight line path. The potential energy stored in the extended elastic launch member 80 propels the submersible projectile 20 in the direction of the extended elastic launch member 80. The stable flight path is achieved by the overall streamlined appearance of the submersible projectile 20 and the fact that the design thereof balances the amount of hydrodynamic lift provided by the body of the projectile against the degree of stabilization provided by the fins.

As can be appreciated, the geometry of the submersible projectile 20 is important to the successful travel thereof. In this regard, Table 1 below presents the preferred magnitudes of selected dimensions of the submersible projectile 20. The distances are set forth in millimeters (mm) and the angles are set forth in degrees. It should be appreciated that these dimensions are preferred and are not intended to limit or restrict the scope of the invention. Applicant contemplates that a different scale (e.g., smaller scale) version of this specific embodiment of the submersible projectile would perform in a satisfactory manner so long as the dimensions maintain their relative proportionality.

TABLE 1

Preferred Magnitudes of Selected Dimensions of the Projectile

| Dimension | Description | Preferred Magnitude (millimeters) |
|---|---|---|
| A | Overall axial length of submersible projectile 20 | 275.4 mm |
| B | Axial length from axial forward end to point of largest generally vertical dimension (or thickness) | 64.9 mm |
| C | Axial length from the point of the greatest vertical thickness to a selected point of vertical thickness H | 56.6 mm |
| D | Axial length from a selected point of vertical thickness H to the axial forward most point of the fin section | 37.7 mm |
| E | Axial length of the fin section | 100 mm |
| F | Axial length of the rearward plug | 16.2 mm |
| G | Vertical thickness of the projectile at the point of maximum vertical dimension [transverse thickness at this point is equal to 51.5 mm] | 31.8 mm |
| H | Vertical thickness of the projectile at the axial forward most point of the fin section [transverse thickness at this point is equal to 46.4 mm] | 29.4 mm |
| I | Vertical thickness of the projectile at the axial forward most point of the fin section | 26 mm |
| J | Maximum height of the fins (fin 54 in FIG. 3) | 25 mm |
| K | Transverse dimension of the projectile at the axial forward most point of the fin section | 46.1 mm |
| L | Vertical distance from the center of the projectile to the tip of fin 56 | 17 mm |
| M | Transverse distance from tip to tip of fin 56 and to the tip of fin 58 | 74.2 mm |
| N | Angle between a horizontal axis HA and the fin 56 | 42.5 degrees |
| O | Angle between fin 56 and fin 58 | 95 degrees |
| P | Angle between horizontal axis HA and fin 54 | 90 degrees |
| Q | Angle between horizontal axis HA and fin 58 | 42.5 degrees |
| R | Angle between fin 54 and fin 56 | 132.5 degrees |

As mentioned earlier herein, the relationship between the surface area of the fins (54, 56, 58) and elliptical cross-section of the projectile body impacts upon the nature of the travel of the submersible projectile 20. The surface area of the fins provides directional stabilization in that there is a proper balance between the center-of-effort and the center-of-pressure for the top and side forces acting on the projectile 20. The elliptical cross-section provides hydrodynamic lift so that the submersible projectile 20 travels underwater at high and low speeds. In the specific embodiment, the surface area of the fins to the area of the elliptical cross-section is such so as to provide for a satisfactory travel path as described hereinbefore.

Although the specific embodiment set forth above has three fins, it should be appreciated that a submersible projectile within the contemplated scope of the invention may include a different number of fins such as, for example, four fins. It should be appreciated that some of the fins may be radial, i.e., project in a radial fashion away from the projectile, and some of fins may be non-radial, i.e., project in a non-radial fashion away from the elongate body of the projectile.

It can thus be seen that the present invention is submersible projectile that presents a design and shape so as to properly balance the amount of hydrodynamic lift against the degree of stabilization provided by the fins that typically project from the rearward portion of the projectile. By doing so, the projectile is able to travel underwater at both high speeds and at low speeds in a satisfactory manner (e.g., a gradually descending substantially straight line path). It can also be seen that the present submersible projectile includes a self-contained propulsion member that can be aligned in a generally parallel direction to the launch direction so that the submersible projectile can be more accurately sighted and launched along the launch direction. It is also apparent that the present submersible projectile permits the user to grasp the projectile in such a fashion so that the user does not interfere with the launch so as to provide an unobstructed launch of the projectile.

All patents, patent applications, articles and other documents identified herein are hereby incorporated by reference herein.

Other embodiments of the invention may be apparent to those skilled in the art from a consideration of the specification or the practice of the invention disclosed herein. It is intended that the specification and any examples set forth herein be considered as illustrative only, with the true spirit and scope of the invention being indicated by the following claims.

What is claimed is:

1. A submersible projectile comprising:

an elongate body having an axial forward end and an axial rearward end and a peripheral surface, and the elongate body has a central longitudinal axis;

the elongate body having a generally elliptical cross-section along substantially all of the axial length of the elongate body;

a plurality of fins projecting from the elongate body near the axial rearward end of the body, and the fins being spaced about the peripheral surface; and wherein one of the plurality of fins is an upper radial fin that has a generally vertical orientation, and the upper radial fin projects in a radial fashion away from the elongate body, and the plurality of fins further includes a plurality of lower non-radial fins that are not aligned to the central longitudinal axis of the elongate body.

2. The submersible projectile of claim 1 wherein the ellipse defined by the elongate body has an eccentricity equal to between about 0.75 and about 0.85.

3. The submersible projectile of claim 1 wherein the elongate body has a specific gravity equal to between about 1.15 and about 1.20.

4. The submersible projectile of claim 1 wherein the plurality of lower non-radial fins comprises two lower non-radial fins.

5. A submersible projectile comprising:

an elongate body having an axial forward end and an axial rearward end and a peripheral surface, the elongate body having a specific gravity equal to between about 1.15 and about 1.20;

the elongate body having a generally elliptical cross-section along substantially all of the axial length of the elongate body, and the ellipse defined by the elongate body in cross-section having an eccentricity equal to between about 0.75 and about 0.85; and a trio of fins projecting from the elongate body near the axial rearward end of the body, and the fins being spaced about the peripheral surface.

6. The submersible projectile of claim 5 wherein one of the fins projecting in a radial fashion away from the elongate body and the other two of the fins projecting in a non-radial fashion away from the elongate body.

7. The submersible projectile of claim 5 wherein the eccentricity is equal to about 0.78.

8. A submersible projectile comprising:

an elongate body having an axial forward end and an axial rearward end and a peripheral surface, the elongate body having a central longitudinal axis;

the elongate body having a generally elliptical cross-section along substantially all of the axial length of the elongate body;

the elongate body containing a propulsion member;

a plurality of fins projecting from the elongate body near the axial rearward end of the body, and the fins being spaced about the peripheral surface; and wherein one of the fins projecting in a radial fashion away from the elongate body and at least two of the fins projecting in a non-radial fashion away from the elongate body.

9. A submersible projectile comprising:

an elongate body having an axial forward end and an axial rearward end and a peripheral surface, the elongate body having a central longitudinal axis;

the elongate body having a generally elliptical cross-section along substantially all of the axial length of the elongate body;

the elongate body containing a propulsion member;

a plurality of fins projecting from the elongate body near the axial rearward end of the body, and the fins being spaced about the peripheral surface; and wherein the propulsion member is an elastic launch member, and the elongate body containing a channel that receives the elastic launch member.

10. The submersible projectile of claim 9 wherein the channel is in general alignment with the central longitudinal axis of the elongate body.

11. The submersible projectile of claim 9 wherein the channel runs substantially the entire axial length of the elongate body.

12. A submersible projectile comprising:

an elongate body having an axial forward end and an axial rearward end and a peripheral surface, the elongate body having a central longitudinal axis;

the elongate body having a generally elliptical cross-section along substantially all of the axial length of the elongate body;

the elongate body containing a propulsion member;

a plurality of fins projecting from the elongate body near the axial rearward end of the body, and the fins being spaced about the peripheral surface; and wherein the propulsion member is an elastic band, and the elongate body contains a pair of generally parallel channels that receive the elastic band, and the channels being in general alignment with the central longitudinal axis of the elongate body.

13. A submersible projectile comprising:

an elongate body having an axial forward end and an axial rearward end and a peripheral surface;

the elongate body having a generally elliptical cross-section along substantially all of the axial length of the elongate body;

a trio of substantially identical fins projecting from the elongate body near the axial rearward end of the body, the fins being spaced about the peripheral surface;

one of the fins projecting in a radial fashion away from the elongate body and the other two of the fins projecting in a non-radial fashion away from the elongate body; and each one of the non-radial fins being spaced apart from the radial fin at an angle between about 130 degrees and about 135 degrees.

* * * * *